US008530010B2

(12) United States Patent
Lenhardt

(10) Patent No.: US 8,530,010 B2
(45) Date of Patent: Sep. 10, 2013

(54) SPACER HAVING A DESICCANT FOR AN INSULATING GLASS PANE

(75) Inventor: Karl Lenhardt, Bad Liebenzell (DE)

(73) Assignee: Plus Inventia AG, St. Gallen (CH)

( * ) Notice: Subject to any disclaimer, the term of this patent is extended or adjusted under 35 U.S.C. 154(b) by 401 days.

(21) Appl. No.: 12/868,000

(22) PCT Filed: Feb. 18, 2009

(86) PCT No.: PCT/EP2009/001155

§ 371 (c)(1),
(2), (4) Date: Sep. 13, 2010

(87) PCT Pub. No.: WO2009/103511

PCT Pub. Date: Aug. 27, 2009

(65) Prior Publication Data

US 2010/0330310 A1 Dec. 30, 2010

(30) Foreign Application Priority Data

Feb. 19, 2008 (DE) ..... 10 2008 010 271
Jul. 16, 2008 (DE) ..... 10 2008 034 027

(51) Int. Cl.
*E06B 3/00* (2006.01)
*E04C 2/54* (2006.01)

(52) U.S. Cl.
USPC ..... 428/34; 52/786.13

(58) Field of Classification Search
USPC ..... 428/34; 52/786.1, 172, 786.13
See application file for complete search history.

(56) References Cited

U.S. PATENT DOCUMENTS

| | | | | |
|---|---|---|---|---|
| 3,775,914 | A | 12/1973 | Patil | |
| 4,226,063 | A | 10/1980 | Chenel | |
| 4,994,309 | A * | 2/1991 | Reichert et al. | 428/34 |
| 5,007,217 | A | 4/1991 | Glover et al. | |
| 5,106,663 | A | 4/1992 | Box | |
| 5,640,815 | A | 6/1997 | Chinzi | |
| 5,773,135 | A * | 6/1998 | Lafond | 428/304.4 |
| 6,370,838 | B1 * | 4/2002 | Evason et al. | 52/786.13 |

FOREIGN PATENT DOCUMENTS

| | | |
|---|---|---|
| DE | 28 16 437 B1 | 8/1979 |
| DE | 31 35 973 A1 | 12/1982 |
| DE | 34 34 545 C1 | 7/1985 |
| DE | 229 23 482 U1 | 11/2000 |
| DE | 202 16 560 U1 | 1/2003 |
| GB | 2 228 519 A | 8/1990 |

* cited by examiner

*Primary Examiner* — Donald J Loney
(74) *Attorney, Agent, or Firm* — Hackler Daghighian & Martino

(57) ABSTRACT

In order to configure an insulated glass pane, two individual glass panes are glued to each other by means of a frame-shaped spacer. For this purpose, a sealant is provided in joints between two flanks of the spacer and the two adjoining glass panes. The joints on the interior of the insulated glass pane are open and contain a mass, which has a surface facing the interior of the insulated glass pane and in which a drying agent is embedded.

31 Claims, 12 Drawing Sheets

SPACER HAVING A DESICCANT FOR AN INSULATING GLASS PANE

The invention is directed to an insulating glass pane having the features specified in the preamble of claim 1. Such an insulating glass pane is known from DE 202 16 560 U1.

In known insulating glass panes, two individual glass plates are glued to one another by a frame-shaped spacer. The spacers typically comprise metal hollow profiles, in particular made of aluminum or steel, which have lateral surfaces, which are referred to hereafter as flanks, facing toward the individual glass plates. The spacers contain a desiccant, in particular zeolites (molecular sieves), which are to absorb moisture, which can be located in the insulating glass pane. For this purpose, the wall of the spacer facing toward the interior of the insulating glass pane is perforated.

Applying a primary, non-setting sealing compound to the flanks of the frame-shaped spacer, which is typically a polyisobutylene, i.e., a thermoplastic butyl rubber, is known. Placing the spacer on a horizontal conveyor for coating using the primary sealing compound, leaning it against a support wall, and guiding it using its leg resting on the horizontal conveyor between two nozzles facing toward one another, using which a strand made of the primary sealing compound is applied to both flanks of the spacer, is known from DE 34 34 545 C1. If a corner of the spacer passes between the nozzles, the feed is interrupted and the spacer is pivoted by 90° to its feed direction, whereby the next leg of the frame-shaped spacer comes to rest on a horizontal conveyor and is then coated next. The procedure is thus continued until the entire spacer is coated on its flanks. A spacer prepared in this manner is then glued in a first installation station on a first glass plate and a second glass plate is glued on the still free flank of the spacer in another installation station and the assembly thus formed is compressed in a flat press to a specified thickness for the insulating glass pane.

The primary sealing compound is primarily used for sealing the insulating glass pane against the penetration of moisture and—if the insulating glass pane was filled with a gas different from air—against the loss of the gas different from air. In the prior art, the primary sealing compound is also used as an installation aid, in that it causes a preliminary cohesion of the insulating glass pane, which is subsequently permanently secured by a secondary sealing compound.

In the insulating glass panes known from DE 28 16 437 A1, the secondary sealing compound is poured into an edge joint, which is delimited by the outer side of the spacer and the two adjoining glass plates. The great majority of the secondary sealing compound accordingly lies on the outer side of the spacer between the two individual glass plates and only a small part thereof penetrates into the two gaps between the two flanks of the spacer and the glass plates, where it encounters the primary sealing compound. Using a curing plastic compound as the secondary sealing compound is known, which produces a rigid bond between the two individual glass plates. Thiokols, polyurethanes, and silicones are typical as such secondary sealing compounds in insulating glass panes.

To reduce the manufacturing expenditure for an insulating glass pane, employing a solid thermoplastic spacer instead of spacers which are formed from hollow profile rods is known, which is extruded in situ on an individual glass plate using a nozzle which is moved along the edge of the glass plate and is then glued to a second glass plate by placement thereof. The spacer which is extruded in situ and is known under the trademark TPS assumes the task of a primary sealing compound; it essentially comprises a thermoplastic polyisobutylene, in which a powdered desiccant is embedded. In order to permanently secure the solid bond between the individual glass plates of the insulating glass pane, a secondary sealing compound is also required in this case, which is poured into the edge joint, which is present on the outer side of the thermoplastic spacer and extends from one glass pane to the other.

The secondary sealing of an insulating glass pane is the most complex part of the insulating glass manufacturing, because it requires increased quantities of an expensive curing two-component plastic, and because its preparation, conveyance, and exact metering are technically demanding and complex. In addition, the entire edge of the insulating glass pane including its corners must be traveled using a nozzle for each insulating glass pane to be sealed, in order to fill the joint present on the entire edge of the insulating glass pane continuously and fully (DE 28 16 437 A1).

In addition, the adhesive quantity required for larger spacer widths rises proportionally to the spacer width.

An insulating glass pane is already known from DE 202 16 560 U1, in which the primary sealing compound and the secondary sealing compound are located in an intermediate space between the flanks of the spacer and the two glass plates; the primary sealing compound is located in two thinner joints, which are adjacent to the interior of the insulating glass pane, while the secondary sealing compound, in contrast, is located in two wider joints, which adjoin the thinner joints for the primary sealing compound and are open outward. The spacer is formed from a metal hollow profile as usual, whose interior is used for receiving a desiccant, which binds moisture present in the insulating glass pane. For this purpose, the wall of the profile facing toward the interior of the insulating glass pane, subsequently also referred to as its inner side, is perforated.

The hollow profile from which the spacer known from DE 202 16 560 U1 is formed touches each of the glass plates along two contact lines on its two flanks, of which one separates the joint for the primary sealing compound from the joint for the secondary sealing compound and of which the second contact line terminates the joint for the primary sealing compound toward the interior of the insulating glass pane.

The present invention is based on the object of disclosing a possibility of how one can achieve more cost-effective insulating glass panes, which are particularly suitable for mass production, without quality losses.

This object is achieved by an insulating glass pane having the features specified in claim 1. Advantageous refinements of the invention are specified in the subclaims.

SUMMARY OF THE INVENTION

In an insulating glass pane according to the invention, a compound, which has a surface facing toward the interior of the insulating glass pane and in which a desiccant is embedded, is located in the joint between the flanks of the spacer and the two glass plates. In order that the desiccant can absorb moisture from the interior of the insulating glass pane, the two joints are open toward the interior of the insulating glass pane. The joints between the flanks of the spacer and the two glass plates are understood as the intermediate space between the flanks and the two glass plates. The flanks of the spacer are understood as its lateral walls or lateral surfaces, which face toward the two individual glass plates in the insulating glass pane.

The invention has the following essential advantages:

The cavity of the spacer can be free of desiccant.

The effort for filling the spacer with a desiccant can be saved.

No device is required for filling the spacer with desiccant.

The spacer does not have to be secured against desiccant trickling out.

Consideration does not have to be taken of desiccant in the spacer when bending the spacer. This simplifies the bending procedure and substantially reduces the risk that the spacer will tear its corners during bending.

Because the flanks of the spacer must be coated using a sealing compound in any case before the spacer is installed in an insulating glass pane, a separate work step is not necessarily required for the application of the compound which contains a desiccant. The application of the desiccant-containing compound and an optionally required separate, setting sealing compound can rather be performed in a single work step.

The expenditure for the production of spacers can be significantly reduced.

The invention is suitable both for metal spacers, in particular those which are formed from hollow profile rods, and also for spacers made of plastic, both for those made of solid plastic, in particular foamed plastic, and also for those made of plastic hollow profiles.

Spacers which are formed from hollow profile rods only still contain air, but no desiccant, because of which they block the heat transfer between two glass panes more strongly than a spacer frame filled with a desiccant. This is correspondingly true for spacers which comprise foamed plastic and do not contain desiccant.

Preferably, any sealing compound for the connection of the spacer to the two adjoining glass plates is only provided in the two joints between the spacer and the two individual glass plates. The sealing compound does not form a bridge extending beyond the outer side of the spacer from one individual glass plate to the other individual glass plate. The outer side of the spacer is understood as the side of the spacer which points outward in relation to the insulating glass pane and connects the two flanks of the spacer.

This has further substantial advantages:

Because a sealing compound which bridges the outer side of the spacer from one glass plate to the other glass plate is not provided, the insulating glass pane also does not require an edge joint for this purpose, which would be filled with sealing compound. The spacer therefore does not have to be offset inward from the edge of the glass plates, but rather can terminate flush or approximately flush with the edge of the glass plates. With uniform external dimensions of the insulating glass pane and with uniform height of the spacer profile, this has the result that the clear inner dimensions of the insulating glass pane increase. The clear inner dimensions are understood here as the height and width of the area of the insulating glass pane exposed by the spacer. The height of the profile of the spacer is understood as the distance between the outer side of the spacer and the side (inner side) of the spacer facing toward the interior of the insulating glass pane.

Greater clear inner dimensions of the insulating glass pane have the advantage of either allowing narrower window frames, because the edge of the insulating glass pane does not have to be bordered so deeply as up to this point, or improving the thermal insulation, because the insulating glass pane is bordered as deeply at the edge as in insulating glass panes whose spacers have a distance from the edge of the insulating glass pane to form an edge joint. A spacer made of a metal hollow profile rod, which represents an undesired cold bridge between the two glass panes, is better insulated from the warmer air space on one side of the insulating glass plates and the colder air space on the other side of the insulating glass pane when it is deeper in the window frame than when it is at the edge of the window frame. At the edge of the window frame, the heat must only traverse the glass pane in order to reach the spacer. However, if the spacer is deeper in the window frame, the heat must additionally overcome a distance in the glass plate parallel to the plane of the glass plate, which inhibits the heat flow, in order to reach the spacer.

Alternatively, the possibility exists of implementing the profile of the spacer as taller by the depth of the saved edge joint, without reducing the clear inner dimensions of the insulating glass pane. This is also an advantage because a still better seal of the insulating glass pane may thus be achieved.

The compound which contains the desiccant has the object of binding the desiccant so that it does not reach the interior of the insulating glass pane. In addition, the compound is to adhere to both the spacer and also the glass plates. For example, compounds based on polyisobutylene, in which the desiccant can be embedded in powdered form, are suitable. Such compounds are prior art for insulating glass manufacturing; for example, they are used for producing plastic spacers in which a powdered desiccant, in particular a molecular sieve, is embedded. Such plastic spacers are known as TPS spacers and the insulating glass panes are known as TPS insulating glass panes. The known TPS spacer is extruded as a strand on one of the glass plates and then joined with the other glass plate to form an insulating glass pane, compare EP 0 782 656 B1 and EP 08 23 531 B1 in this regard. A greater part of the desiccant-containing compound is saved according to the invention in relation to a TPS insulating glass pane, without being disadvantageous for the sealing of the insulating glass pane and for achieving a low dewpoint in the interior of the insulating glass pane. This is an advantage of the present invention.

The compound in which the desiccant is embedded does not hermetically seal the desiccant. Rather, water vapor present in the interior of the insulating glass pane can diffuse very slowly into the compound containing the desiccant and is bound therein by the desiccant.

The compound containing the desiccant is preferably used not only for embedding the desiccant, but rather also assumes a sealing task, in that it is either a primary sealing compound, which does not set, or in that it contains such a primary sealing compound. A compound based on polyisobutylene, as the TPS material is, is therefore well suitable for the purposes of the invention. In combination with the embedded desiccant, on the one hand, it prevents water vapor from diffusing into the interior of the insulating glass pane and, on the other hand, it binds moisture which is still contained after assembly of the insulating glass pane in its interior and causes a lower dewpoint, which prevents fogging of the insulating glass pane from the inside under normal usage conditions. Surprisingly, it has been shown that the desiccant-containing sealing compound results in a very good seal of the insulating glass pane, although moisture can penetrate into the sealing compound and although the quantity of desiccant contained in the joint between the flanks of the spacer and the glass panes in the sealing compound is substantially less than in spacers made of hollow profile rods, which are filled with the desiccant, and is substantially less than in TPS spacers.

If the compound containing the desiccant is or contains a primary sealing compound, a secondary sealing compound is to join the desiccant-containing compound in the edge joints of the insulating glass pane, which sets in order to produce the required solid mechanical bond between the glass plates and the spacer, which is maintained even when a high temperature occurs in the secondary sealing compound due to sunlight. The compounds which are already known for this purpose in insulating glass production are suitable as the secondary sealing compound, in particular Thiokols (polysulfides), polyurethane, and setting silicones.

However, it is also possible to select a secondary sealing compound which sets as the compound which contains the desiccant. Such a secondary sealing compound is less diffusion-tight with respect to water vapor than a primary sealing compound such as a polyisobutylene, but the secondary sealing compound can embed the desiccant and also produce the required solid bond between the spacer and the glass panes. The tightness to water vapor diffusion which is not as good eases the access to the desiccant, which binds the water vapor, to the water vapor existing in the insulating glass pane. In order to prevent the diffusion of water vapor from the exterior into the insulating glass pane, a compound containing desiccant based on a setting secondary sealing compound is expediently supplemented by a non-setting primary sealing compound such as a polyisobutylene, which permanently opposes the diffusion of water vapor with a high resistance. The primary sealing compound is to join the desiccant-containing compound based on a secondary sealing compound toward the outside in the joints which are present between the flanks of the spacer and the glass panes.

The secondary sealing compound which optionally adjoins the desiccant-containing compound is preferably a one-component or two-component reactive adhesive, such as a reactive hot-melt adhesive, which can only be melted once and then sets. This refinement of the invention is particularly favorable if the compound containing the desiccant is a primary sealing compound based on a polyisobutylene.

Compounds which connect a sufficient tightness to the diffusion of water vapor in to a sufficient mechanical strength even at elevated temperatures, as may occur in insulating glass panes, are also suitable for the purposes of the invention. An insulating glass pane according to the invention can also solely be sealed using such a compound, in which a desiccant is embedded. For this purpose, such a desiccant-containing compound is only applied to the flanks of the spacer, which is then solidly, permanently, and tightly connected to the glass plates solely by this compound to form an insulating glass pane.

If the spacer profile has a greater height than in the prior art, this also applies for its flanks. If a sealing compound is applied to the flanks of such a spacer profile in a quantity and configuration such that it covers the entire area of the flanks in combination with a desiccant-containing sealing compound in any case after the compression of the insulating glass pane to its target thickness, a greater sealing depth is obtained in the joint between the flanks of the spacer and the adjoining glass plates according to the invention than in the prior art, while simultaneously saving a significant quantity of the costly sealing compound. Savings of sealing compound from 50% to 80% over the prior art are realistic. The savings of sealing compound do not result in worsening of the water vapor tightness and gas tightness of the insulating glass pane, however, in that if one can assume the spacer itself is water-vapor-tight and gas-tight, which is true for a metal spacer in any case, the water vapor tightness and the gas tightness of the insulating glass pane depends on the nature and tightness of the sealing compound in the gap between the spacer and the adjoining glass plates and on the dimensions of the joint. If the sealing compound is provided without pores in the joint, the tightness of the insulating glass pane is only still dependent on the nature of the sealing compound and on the length, width, and depth of the sealed joint between the spacer and the adjoining glass plates. The length of the joint is specified by the circumference of the insulating glass pane. The width of the joint between the flanks of the spacer and the two adjoining glass plates is already small in the prior art. For deepening of the joints, a clearance is particularly provided according to the invention if—as is preferable—the frame-shaped spacer is implemented so that its outer side runs flush or approximately flush with the edges of the glass plates or—if the two glass plates of an insulating glass pane are not equally large—it runs flush or approximately flush with the edge of the smaller glass plate. If one prefers a greater clear width of the insulating glass pane, an approximately doubled seal depth and accordingly a wider adhesion surface between the spacer and the glass plates is possible—compared to the prior art—with significantly smaller quantities of sealing compound, and a higher degree of tightness may therefore be expected. The demand for sealing compound remains equal independently of the spacer width, i.e., the demand for sealing compound does not depend on the width of the spacer.

In the prior art, the hollow spacers contain a desiccant and are provided with small holes on the side facing toward the interior of the insulating glass pane, through which moisture can enter the spacer from the interior of the insulating glass pane, and can be received and bound, absorbed, or adsorbed by the desiccant. The production of the small holes in the spacer can be dispensed with according to the invention. Preferably, both the wall facing toward the interior of insulating glass pane and also the wall diametrically opposite thereto, which points outward—the base of the spacer profile—are completely tight, so that the spacer itself forms a double seal for the insulating glass pane. If the spacer profile is not produced by extrusion, but rather by folding or roll forming from a sheet-metal strip, the longitudinal edges of the sheet-metal strip are preferably guided together at one of the two flanks of the spacer profile and connected to one another by welding using a laser, for example, so that a possibly leaky weld seam is sealed by sealing compound applied to the flanks, in particular by a primary sealing compound. Preferably none of the peripheral walls of the hollow profile rod from which the spacer is formed has an opening. If the hollow profile rod is an extruded profile, it already does not have an opening in its peripheral walls because of its production. If it is a profile formed from a sheet-metal strip by roll funning, it is preferably to be ensured that the weld seam which connects the two longitudinal edges of the sheet-metal strip in the hollow profile rod to one another is continuously tight. The production of the hollow profile rods by extrusion is particularly suitable for hollow profile rods made of aluminum. The production by roll forming or roll profiling from strip-shaped sheet-metal is suitable above all for hollow profile rods made of stainless steel.

Not only the tightness, but rather also a sufficiently solid bond of the insulating glass pane, are to be permanently ensured by sealing compound in the joint between the spacer and the individual glass plates. A sufficient pressure resistance is already achieved by a sufficiently stable spacer, which can be formed from profile rods made of metal or plastic. A sufficient tensile and shear strength of the insulating glass pane is also achieved at elevated temperatures by the use of a setting sealing compound, which can be used in connection with a non-setting sealing compound, such as a polyisobutylene.

A greater depth of the gap between the flanks of the spacer and the glass plates, which is possible according to the invention, favors managing using only a single sealing compound, in contrast to the prior art, and achieving sufficient tightness using only one type of sealing compound. It is expediently to be a sealing compound which does set and cure, but has a greater amount of permanent elasticity, than do secondary sealing compounds based on Thiokol or polyurethane, which are currently typical in insulating glass panes. Examples of such a sealing compound which are used as the sole sealing compound in an insulating glass pane and in which a powdered desiccant can be embedded are disclosed in WO 2008/005214 A1, the content of whose disclosure is expressly made reference to here, in order to incorporate it in the present patent application.

The invention is not restricted to working with only one type of sealing compound. The use of two sealing compounds which reasonably supplement one another in their properties is advantageous: A primary sealing compound, which receives the desiccant and simultaneously has a particular suitability for sealing, such as a polyisobutylene, and a secondary sealing compound, which has a particular suitability for the permanent solid bonding of the glass plates, in particular a curing plastic compound, such as a polyurethane or a Thiokol (polysulfide), a reactive polyisobutylene, a silicone, or also a hot-melt adhesive, in particular a reactive hot-melt adhesive.

Both the primary sealing compound containing the desiccant and also the secondary sealing compound may be applied to the flanks of the spacer before the assembly of the insulating glass pane, it being preferable to apply the primary sealing compound adjacent to the inner side of the spacer and the secondary sealing compound adjacent to the outer side of the spacer. This can be performed simultaneously, for example, by coextrusion, or overlapping in time, but slightly offset, for example, first the primary sealing compound and then the secondary sealing compound, preferably in the same station, so that a separate sealing station or sealing machine, in which the secondary sealing compound is applied to the spacer or introduced into the edge joint of an insulating glass pane in the prior art (DE 28 16 437 A1), can be dispensed with. Because the sealing machines are generally the most expensive machines in an insulating glass manufacturing line, this means an enormous cost savings with a significantly lower space requirement.

The primary sealing compound and the secondary sealing compound may already be applied according to the invention to the flanks of the profile rods before they are formed into a spacer frame. A device, as is described in DE 34 34 545 C1 for displacing and pivoting spacer frames during the coating of their flanks using a primary sealing compound, is not required in the production of an insulating glass pane according to the invention and can be dispensed with. This is a further advantage of the invention.

The invention is not only suitable for insulating glass panes in which two individual glass plates are glued to one another by a frame-shaped spacer, but rather also for insulating glass panes in which more than two glass plates are each glued to one another in pairs by a frame-shaped spacer, in particular for insulating glass panes in which three individual glass plates are glued to one another by two frame-shaped spacers.

The spacer is preferably situated so that it terminates flush with the edges of the individual glass plates. In stepped insulating glass panes, which are composed of a larger glass plate and a smaller glass plate, the spacer preferably terminates flush with the edge of the smaller glass plate. A flush terminus allows the greatest sealing depth and/or the best thermal insulation and reduces both the danger of splinters from the edge of the insulating glass pane, and also its contamination by possibly overflowing sealing compound. The spacer can even be situated so that it protrudes beyond the edge of the individual glass plate and thus forms the edge of the insulating glass pane itself. This additionally reduces the danger of splinters from the edge of the insulating glass pane, in particular during the transport and installation of the insulating glass pane in a window frame or in a facade.

Typical spacer profiles have a profile height of 6 mm 8 mm. Such profile heights are also suitable for the purposes of the invention. If—as is preferable—the spacer terminates flush or approximately flush with the edge of the glass plates, the spacers may also have a profile height of 8 mm to 12 mm in an insulating glass pane according to the invention. Thus, in spite of simultaneously dispensing with the edge joint provided in the prior art for a setting secondary sealing compound, greater sealing depths can be achieved than in the prior art.

However, spacers having a lower profile height of 7 mm to 9 mm, preferably from 7 mm to 8 mm, are preferably used in an insulating glass pane according to the invention. It has been shown that such a low profile height is sufficient and has the advantage of a material savings.

The insulating glass pane according to the invention preferably has a primary, non-setting sealing compound, which contains the desiccant, and a secondary, setting sealing compound in the joint between the flanks of the spacer and the adjoining glass plates adjacent to one another. The primary sealing compound expediently terminates at the interior of the insulating glass pane and the secondary sealing compound expediently terminates directly at the side of the primary sealing compound facing away from the interior of the insulating glass pane and extends up to the edge of the insulating glass pane. The primary sealing compound, which is preferably applied before the secondary sealing compound, having the embedded desiccant represents an effective barrier for the secondary sealing compound. This advantage is also achieved if the primary and the secondary sealing compounds are applied overlapping in time, the application of the primary sealing compound leading the application of the secondary sealing compound. This barrier cannot be overcome by the second, secondary sealing compound during compression of the insulating glass pane. A two-step bond, which is advantageous for the tightness and the cohesion of the insulating glass pane, is thus achieved.

If a primary sealing compound containing the desiccant has been applied to the flanks, the secondary sealing compound adjoins it directly, gaps being avoided as much as possible. If only a single sealing compound is used, which causes both the required seal and also the permanent mechanical bond and contains the desiccant, it is to extend over the entire height of the flanks of the spacer. The great seal depth possible according to the invention encourages working with only one sealing compound, which can be a reactive, one-component sealant and adhesive based on a polyisobutylene or a hot-melt adhesive or a sealing compound disclosed in WO 2008/005214 A1. Through the use of such an adhesive and sealant as the sole sealing compound, further cost savings may be achieved in the insulating glass manufacturing.

The spacer preferably has a hollow profile, in particular a box profile. Although spacers which are formed from a hollow profile typically receive the desiccant in the prior art, this is not preferable in the context of the present invention, rather the cavity of the spacer preferably contains no desiccant at all. Rather, the desiccant is located in the joints between the spacer and the adjoining glass plates.

The inner side of the spacer facing toward the interior of the insulating glass pane is preferably narrower than the outer side of the spacer facing away from the interior of the insulating glass pane. This is a further departure from the prior art. Up to this point, as disclosed in DE 202 16 560 U1, the greatest width of the spacer has been provided on its inner side facing toward the interior of the insulating glass pane and it has been implemented narrower on its outer side, in order to be able to house more secondary sealing compound there for the solid mechanical bond of the insulating glass pane. In a refinement of the present invention, these ratios are precisely reversed: The spacer is preferably narrower on its inner side facing toward the interior of the insulating glass pane than on its outer side, or narrower than at its widest point. This has the advantage that in the section of the joints which adjoins the interior of the insulating glass pane, more desiccant-containing compound and thus more desiccant can be housed than if the spacer were not narrower adjoining its inner side than at its widest point lying further outward. In addition, it has been shown that a very much smaller quantity of the secondary sealing compound than has been used up to this point is already sufficient to produce a reliably solid bond of the insulating glass pane.

In particular, it is advantageous to implement the spacer so that its flanks run parallel to one another in an area adjoining the outer side of the spacer up to a specified distance from the outer side, and the flanks approach one another in the area between this specified distance from the outer side of the spacer and the inner side of the spacer. Where the two flanks run parallel to one another, the secondary sealing compound is provided in a comparatively thinner layer, which produces the solid bond between the spacer and the glass plates. The desiccant-containing compound is provided on the adjoining area of the flanks, where the cross-section of the spacer tapers.

The flanks may be implemented as stepped and allow a wider joint for the desiccant-containing compound than for the secondary sealing compound in this way. Another advantageous possibility comprises implementing the flanks as concave in cross-section in the area between the specified distance and the inner side of the spacer. This makes it easier to fill the joints between the spacer and the glass panes continuously.

A refinement of the insulating glass pane according to the invention in which both flanks of the spacer each have an intermediate area and each have two areas adjoining the intermediate area and enclosing the intermediate area between them is particularly preferred. The two intermediate areas are parallel to one another, have an equal distance from the outer side of the base of the spacer profile, and are of equal height, the spacer profile being narrower in the areas adjoining the particular intermediate area than in the intermediate area. The height of the intermediate area is understood as the extension of the intermediate area perpendicular to the base of the spacer profile. Such a spacer has the greatest width where the intermediate areas of the spacer profile are situated. In the adjoining areas, i.e., both in the direction toward the base and also in the direction toward the inner side of the spacer profile, it is narrower than in the height of the intermediate areas.

Using this implementation of the spacer, its flanks fulfill a threefold function: The intermediate areas run parallel to the two glass panes which are held at a distance by the spacer, are glued to the two glass panes using a thin layer of a sealing compound, and substantially determine the distance between the two glass panes of the insulating glass pane. In the two areas adjoining the particular intermediate area, there is an intermediate space in the insulating glass pane in each case between each of the flanks of the spacer and the particular diametrically opposite glass plate thereto, which is wider than the gap between the intermediate area and the glass plate adjacent thereto. One intermediate space is open toward the interior of the insulating glass pane and receives a desiccant-containing sealing compound. The other intermediate space is open outward and receives a desiccant-free sealing compound, in particular a setting secondary sealing compound, if two sealing compounds are provided in the insulating glass pane. If only a single sealing compound is provided in the insulating glass pane, it is a desiccant-containing, setting sealing compound, such as one of the sealing compounds which are disclosed in WO 2008/005214 A1.

The use of a spacer which has narrower sections adjoining the intermediate area of its flanks has substantial advantages: The intermediate area can be glued to the glass plates by a sealing compound which is only required as a thin layer. The intermediate spaces adjoining thereon in the direction toward the interior of the insulating glass pane may receive a larger quantity of desiccant-containing compound, which is sufficient to keep the dewpoint in the insulating glass pane so low that under normal environmental conditions and during an average lifetime of 25 to 30 years, fogging of the insulating glass pane from the inside is prevented. The wider intermediate spaces between the spacer and the glass plates, which are open to the outside, may not only receive a sufficient quantity of the secondary sealing compound, but rather, in combination with the intermediate spaces which are open toward the interior of the insulating glass pane, ensure that bends of the individual glass plates as a result of wind loads, temperature strains, and variations of the ambient pressure do not result in hairline cracks in the sealing compounds, which could result in a leak of the insulating glass pane. During such bending movements, the narrow intermediate areas of the flanks represent a fixed point for the bending movement, which drags on the sealing compound in one or another of the adjoining intermediate spaces between the particular flank and the glass plate diametrically opposite thereto, but does not result in cracking in the sealing compound there, because this sealing compound is provided in such a great thickness in the intermediate spaces adjoining the intermediate area of the flanks that the cracking resistance of the sealing compound is not exceeded there.

The intermediate area on the particular flank of the spacer is expediently implemented as level.

The areas of the flanks adjoining the particular intermediate area may be implemented as sharp-edged and stepped, but are preferably implemented as concave in cross-section, preferably having a rounded contour, which encourages continuous filling of the intermediate spaces between the flanks of the spacer and the adjoining glass plates using sealing compound.

In cross-section, the areas of the flanks adjoining the particular intermediate area of the flanks preferably have such a contour that the spacer profile tapers starting from the intermediate area toward the outer side of the base of the spacer profile and toward the inner side of the spacer profile or first tapers and then merges into a uniform tapered area, in which the flanks run parallel to the intermediate areas. It is to be noted thereon that the inner side of the spacer is understood here as the side of the spacer facing toward the interior of the insulating glass pane.

It is also possible to select a contour of the area adjoining the particular intermediate area of the flanks so that the spacer profile first tapers starting from the intermediate area and then widens again upon approaching the outer side of the base and/or the inner side of the spacer profile, so that an undercut arises on the flanks. Such an implementation is not preferred, however, because it can make the sealing of the insulating glass pane more difficult.

The spacer profile is preferably implemented as mirror-symmetric to the longitudinal central plane of the spacer which runs parallel to the intermediate areas. In relation to another longitudinal central plane, namely in relation to the longitudinal central plane which runs parallel to the outer side and to the inner side of the spacer profile, the spacer profile may also be mirror-symmetric. However, this is not preferable. It is preferable for the intermediate spaces between the glass plates and the areas of the flanks adjoining the inner side of the spacer profile to differ in their size from the intermediate spaces between the glass plates and the areas adjoining the bottom side of the spacer profile. Specifically, this makes it possible to use the same spacer profile with different intended goals: If a large volume of the desiccant-containing compound is valued above all, the spacer profile in the spacer is used so that the larger intermediate spaces between the glass plates and the flanks face toward the interior of the insulating glass pane.

However, if more value is placed on a greater volume of secondary sealing compound, the spacer profile is used so that the larger intermediate spaces between the glass plates and the flanks of the spacer face outward.

It has already been noted that the profile rods from which frame-shaped spacers are formed are preferably already coated using sealing compound, as long as they have not yet been bent into a frame-shaped spacer, but rather are still linear. In order to make the bending procedure easier, the profile rods have grooves or waves at least on their inner side, i.e., on the side which later faces the interior of the insulating glass pane in the insulating glass pane, running perpendicularly to the intermediate areas of the flanks. Such grooves or waves are preferably also provided on the outer side of the base of the profile rods. Each individual groove defines a possible intended bending point and makes stretching of the profile-base easier during bending. The grooves or waves preferably end at a distance from the flanks, in order to prevent undesired, outwardly directed warping of the flanks during bending.

If the sections of the flanks parallel to one another extend up to the outer side of the base of the spacer profile and the spacer profile is only narrower adjoining its inner side than on its outer side, it is preferable for the sealing compound to be provided in a thickness of 0.75 mm to 1.25 mm, in particular in a thickness of approximately 1 mm, in the gap between the glass plates and the sections of the flanks parallel thereto. This is sufficient to prevent the occurrence of fine cracks in the sealing compound in the event of strain by alternating wind loads, alternating temperatures, and alternating external air pressures. However, if spacer profiles are used which are narrower on both sides of an intermediate area of the two flanks which is parallel to the adjoining glass plate than measured over the intermediate areas, the occurrence of cracks in the sealing compound as a result of alternating pressure, temperature, and wind strains can already be prevented using a substantially thinner layer of the sealing compound in the gap between the intermediate areas of the flanks and the adjoining glass plates, namely using a thickness of the sealing compound of only 0.25 mm to 0.45 mm, preferably only 0.3 mm to 0.4 mm. In order to generate such a thin layer of the sealing compound, the insulating glass pane does not have to be compressed in a controlled manner to a specified thickness, but rather it is sufficient to act on the insulating glass panes using a specified specific pressure of 40 N per running centimeter of the circumference of the spacer, for example.

BRIEF DESCRIPTION OF THE DRAWING

Exemplary embodiments of the invention are shown in the appended drawings. Identical or corresponding parts are identified in the various examples using corresponding reference numerals.

DETAILED DESCRIPTION

Figure 1:
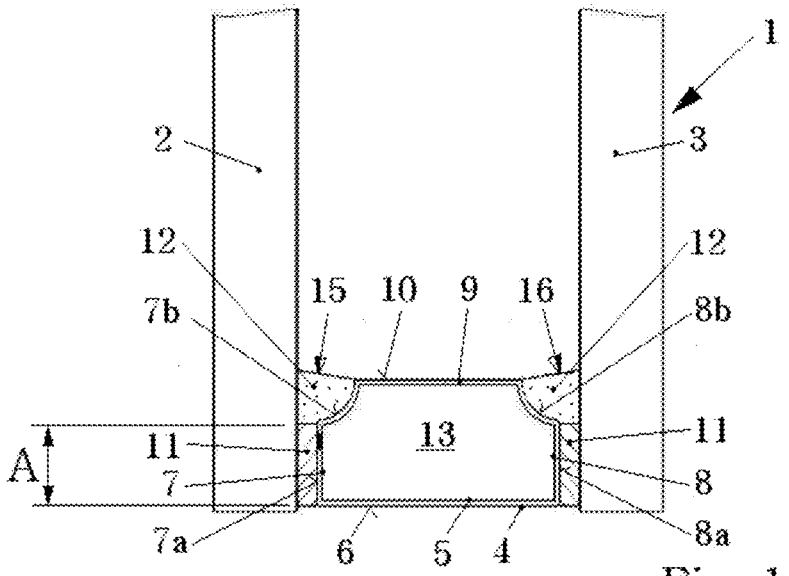
FIG. 1 shows a cross-section through a part of an insulating glass pane according to the invention.

FIG. 1 shows a detail of an insulating glass pane 1, comprising two individual glass plates 2 and 3, between which a frame-shaped spacer 4 is located, which is formed from a hollow profile rod, which has a box profile in cross-section and can be produced by extrusion, for example. The production by extrusion is particularly suitable for hollow profile rods made of aluminum. Hollow profile rods made of stainless steel—the material having the German material number 1.4372 is particularly suitable—are better produced by roll profiling from sheet steel, however. Roll profiling is also referred to as roll forming. The spacer 4 has a base 5 in cross-section, which has a flat outer side 6. Two legs 7 and 8 which are identical in mirror image, and which lead to a wall 9 parallel to the base 5, whose top side 10 faces toward the interior of the insulating glass pane, originate from the base 5. The wall 9 is therefore also referred to here as the inner side of the spacer 4.

The legs 7 and 8 form the flanks of the spacer 4. They have two parallel sections 7*a* and 8*a* adjoining the base 5, which extend up to a predefined distance A from the base 5. A section 7*b* or 8*b*, respectively, which is concave in cross-section adjoins them there.

A secondary sealing compound 11 is preferably applied to the flanks 7 and 8 in the area of the parallel wall sections 7*a* and 8*a*, which solidly bonds the spacer 4 to the two glass plates 2 and 3 and cures, for example, a one-component or two-component reactive adhesive. A compound 12 having a desiccant embedded therein is preferably applied to the parallel wall sections 7*b* and 8*b*. This compound can be a primary sealing compound based on a polyisobutylene, in which a molecular sieve powder is embedded as a desiccant, such as a TPS compound. The sections 7*a* and 7*b* or 8*a* and 8*b* of the flanks 7 and 8 of the spacer 4 may be coated in a common work step, and are preferably coated on the two flanks 7, 8 using the desiccant-containing compound and using secondary sealing compound while the rod-shaped spacer profile is still in the stretched position, i.e., is linear, and preferably using two nozzles in each case, which are situated offset to one another. Each two nozzles are moved jointly but one behind another along the flanks 7, 8. After the coating of the spacer profile rod, a polygonal, in particular a rectangular frame-shaped spacer can be formed therefrom, in particular in that the profile rod is folded at the positions provided for the corners. This can be performed by machine, but also readily by hand, the folding being particularly simple because the base 5 and the inner side 10 of the spacer profile are free of any coating using an adhesive compound, so that they may be readily grasped.

The desiccant-containing compound 12 and any other sealing compound 11 are exclusively located in the two joints 15 and 16 between the flank 7 and the glass plate 2 and between the flank 8 and the glass plate 3. The joints 15 and 16 comprise a gap 24, which is delimited on one side by the glass plates 2 and 3 and on the other side by the walls 7*a* of the flank 7 parallel to the glass plate 2 or by the wall 8*a* of the flank 8 parallel to the glass plate 3, and by an intermediate space 25, which is between the glass plates 2 and 3 on one side and the concave section 7*a* and 8*a* of the flanks 7 and 8 and widens from the gap 24 up to the top side 10 of the spacer 4, which faces toward the interior of the insulating glass pane 1.

The interior 13 of the spacer 4 is empty, it does not contain desiccant. All of its walls 5, 7, 8, and 9 are sealed, they are impermeable to water vapor and gases, in particular heavy gases, which may be provided instead of air in the insulating glass pane.

Figure 4:
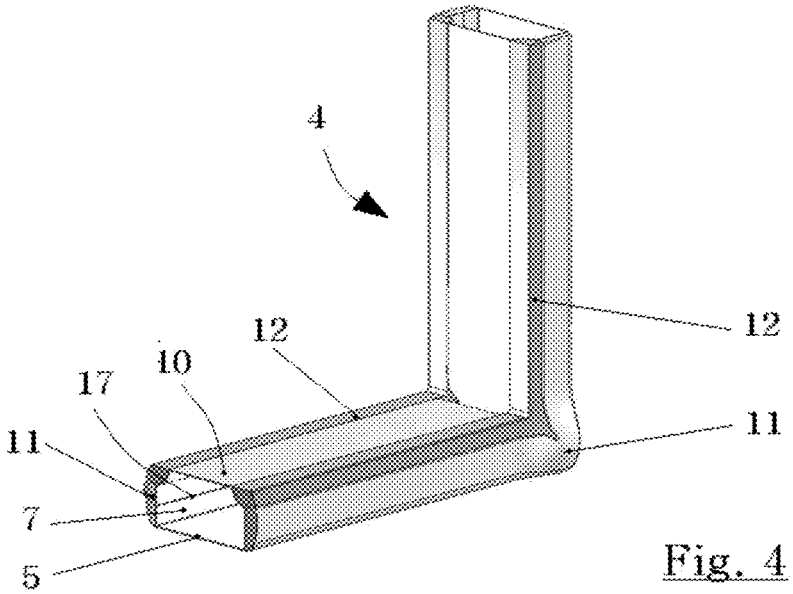
FIG. 4 shows the coated spacer from FIG. 3 after the compression of the insulating glass pane, but the glass panes are left out in the figure, in contrast to FIG. 3.

In order to form a frame-shaped spacer 4, which generally has a rectangular outline, from the originally linear hollow profile rod, the hollow profile rod is preferably notched at the points at which a corner of the frame-shaped spacer is to be formed, at the flanks 7 and 8 and at the top side 10, which becomes the inner side of the spacer. The flanks thus do not bulge outward, but rather collapse upon bending of the corners, and the top side 10 of the hollow profile rod folds inward in the predetermined manner upon bending of a corner. The notching of the flanks 7 and 8 and the top side 10 is performed so that the hollow profile rod does not tear during the notching or the later bending. The notching is performed before the coating of the flanks 7 and 8 using desiccant-containing compound 12 and using secondary sealing compound 11. The notch points on the flanks 7 and 8 are then covered by the compound 12 having embedded desiccant and by the secondary sealing compound 11, as shown in FIG. 4. In spite of a collapse of the flanks 7 and 8 in the area of the corners, a complete seal of the insulating glass pane 1 is achieved in this critical area, because, through the bending or folding of the hollow profile rod to form the corner, an excess of compound 12 having embedded desiccant and a secondary sealing compound 11 is built up on the flanks 7 and 8 in the area of the corner, which is distributed upon compression of the insulating glass pane and thus ensures a sealed corner. The fold 27, which is formed upon folding or bending of a corner on the inner side 10 of the spacer 4, is well visible in FIG. 4. It has a reproducible, pleasing appearance as a result of the preceding notching procedure.

Figure 2:
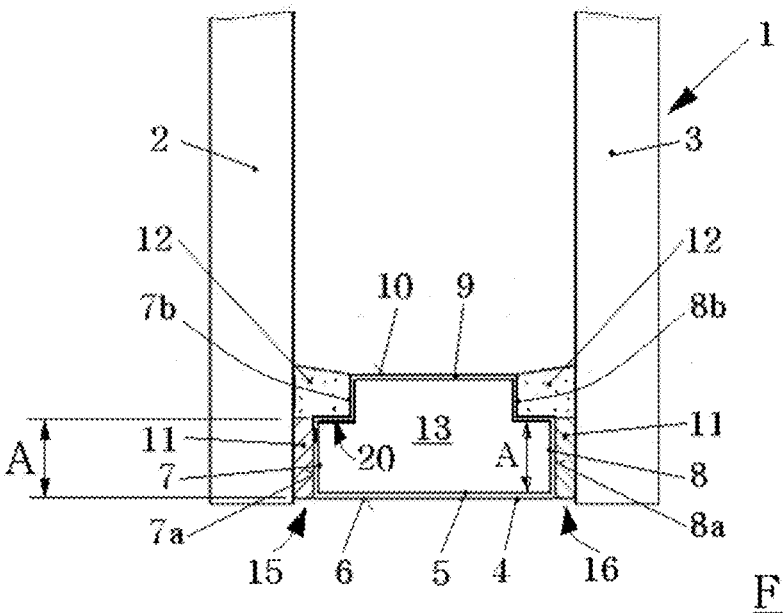
FIG. 2 is a cross-section through an alteration of the insulating glass pane shown in FIG. 1.
Figure 3:
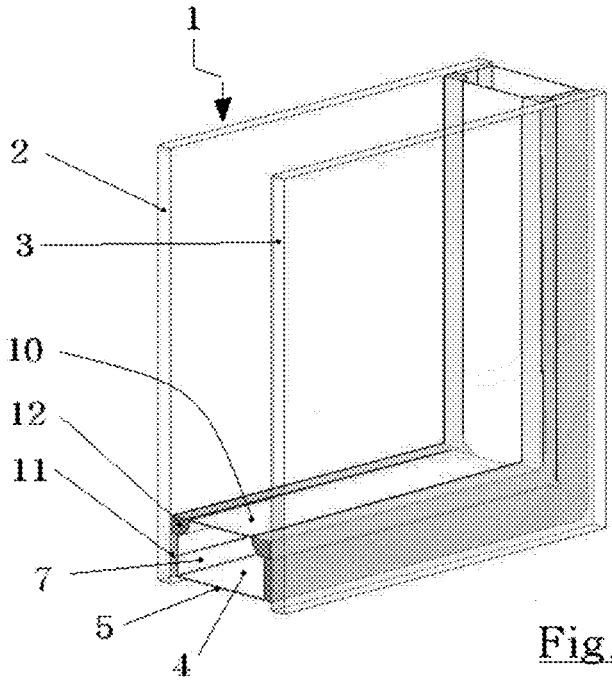
FIG. 3 is a diagonal view of a section of the insulating glass pane shown in FIG. 1.

The exemplary embodiment shown in FIG. 2 differs from the exemplary embodiment shown in FIG. 1 in that the spacer profile does not have convex sections 7*b* and 8*b* on the flanks 7, 8, but rather is instead implemented as stepped.

Figure 5:
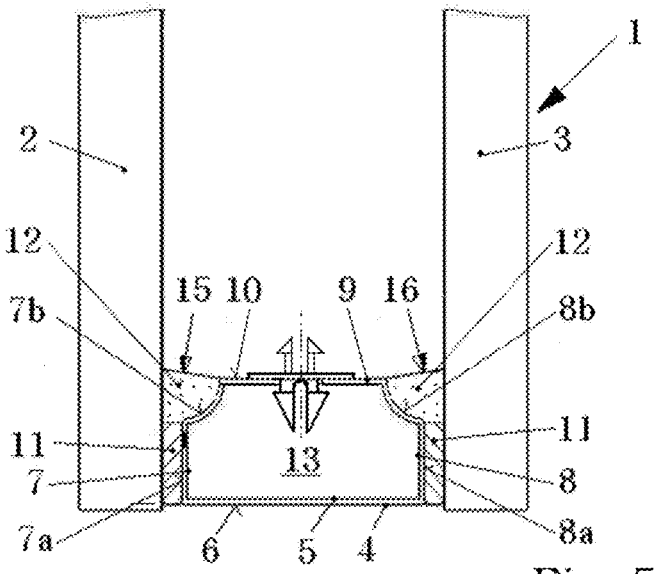
FIG. 5 is a cross-section through the insulating glass pane shown in FIG. 1 having an adapter for the attachment of a sash bar.
Figure 6:
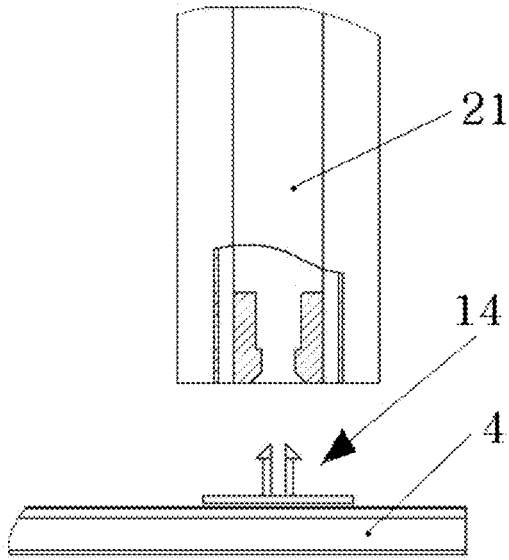
FIG. 6 shows an alternative adapter fastening on the spacer.

The exemplary embodiment shown in FIG. 5 differs from the exemplary embodiment shown in FIG. 1 in that adapters 14 are anchored on the top side 10 of the profile rod, on which sash bars 21 may be plugged, as shown in FIG. 6. The adapters 14 may be plugged through a hole in the wall 10, which forms the top side of the profile rod, at the points provided for this purpose. The hole is preferably drilled at the point provided for this purpose, as long as the corners of the frame-shaped spacer 4 are not yet formed, i.e., as long as the hollow profile rod is not bent to form corners, best before the desiccant-containing compound 12 and the other sealing compound 11 have been applied to the flanks 7 and 8 of the hollow profile rod. A gap between the edge of the hole in the wall 9 and the adapter 14 can be sealed by a sealant if necessary.

Alternatively, the adapter 14 for a sash bar 21 can also be glued onto the top side 10 of the hollow profile rod. This is shown in FIG. 6 and has the advantage that the hollow profile rod is not damaged there. The fastening of the adapter 14 on the top side 10 of the hollow profile rod by gluing is preferred.

Figure 7:
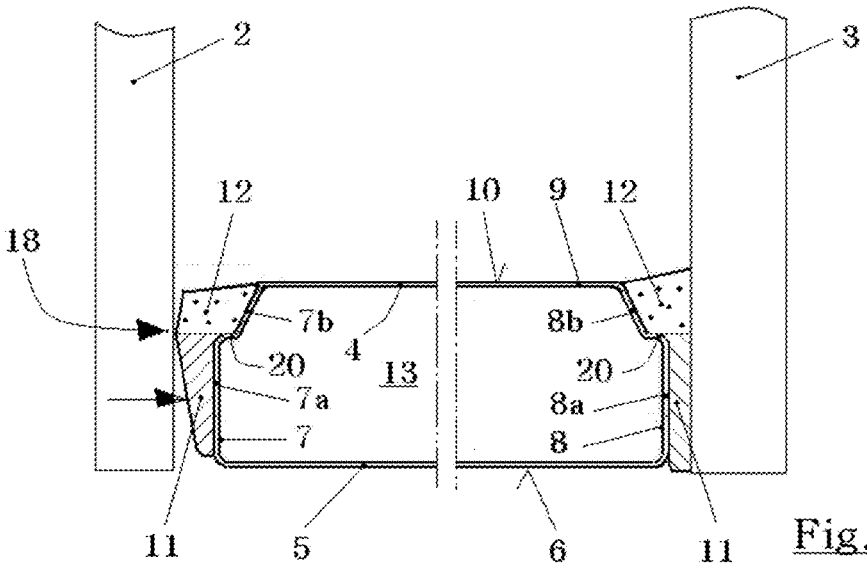
FIG. 7 shows a cross-section of a spacer profile altered in relation to FIGS. 1 to 5, whose flanks are coated using a primary and a secondary sealing compound, on the left side of the figure before the compression with a glass plate and on the right side after the compression with a glass plate.

FIG. 7 shows that a primary sealing compound 12, which contains a desiccant, and the secondary sealing compound 11, which sets, are preferably applied to the flanks 7 and 8 of the spacer so that they directly adjoin one another from the outset, and the course of the thickness of the layer which is applied is selected via the height of the spacer profile so that the sealing compounds 11 and 12 protrude furthest from the respective flanks 7 or 8 where the two sealing compounds 11 and 12 meet. From there, the width of the coated spacer profile tapers both in the direction upward, i.e., in the direction toward the top side 10 of the wall 9, and also downward, i.e., toward the outer side 6 of the base 5 of the spacer profile, as shown in the left half of FIG. 7. This has the advantage that during the subsequent compression of the sealing compounds 11 and 12 between the spacer 4 and the two glass plates 2 and 3, the danger that air bubbles will be enclosed between the sealing compounds 11 and 12 on one side and the glass plates 2 and 3 on the other side is minimal. Specifically, the compression begins at the first position 18 relevant to the glass plate 2 or 3, at which the two sealing compounds 11 and 12 border one another, and progresses upward and downward originating from there, so that the air can be displaced from the initially wedge-shaped gaps between the sealing compounds 11 and 12 on one side and the glass plates 2 and 3 on the other side, After the completion of the compression procedure, the image shown in the right side of FIG. 7 results.

Figure 8:
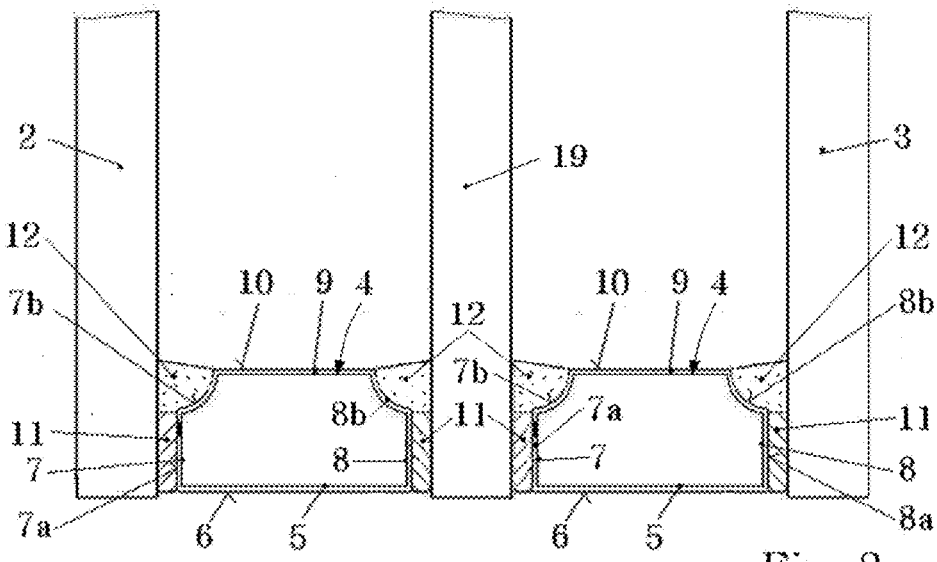
FIG. 8 shows a cross-section through a part of an insulating glass pane, assembled from three glass plates and two spacers, in a view corresponding to FIG. 1.

FIG. 8 shows the application of the invention to the production of a triple insulating glass pane, which comprises three glass plates 2, 3, and 19, which are held at a distance from one another in pairs by a spacer 4 in each case. In both cases, the sealing compounds 11 and 12 are located exclusively in the intermediate space between the flanks 7 and 8 of the spacer 4 and the particular adjacent glass plate 2, 3, and 19.

Figure 9:
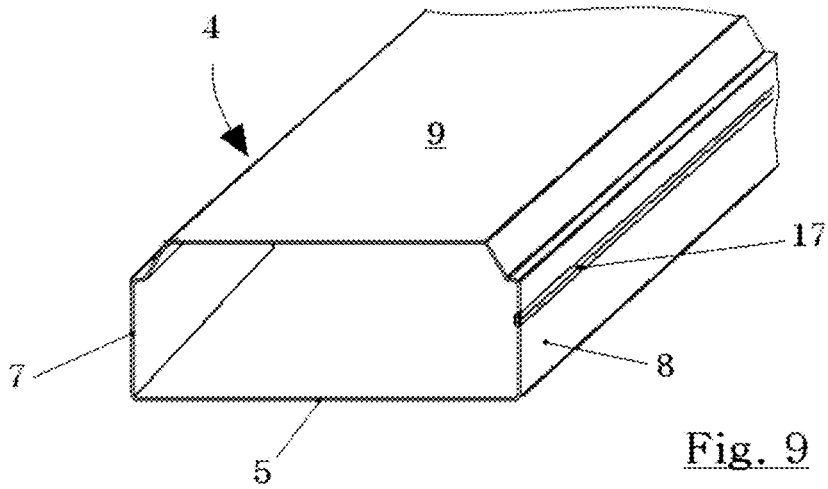
FIG. 9 shows a diagonal view of a spacer profile having a seam which lies on a flank.
Figure 10:
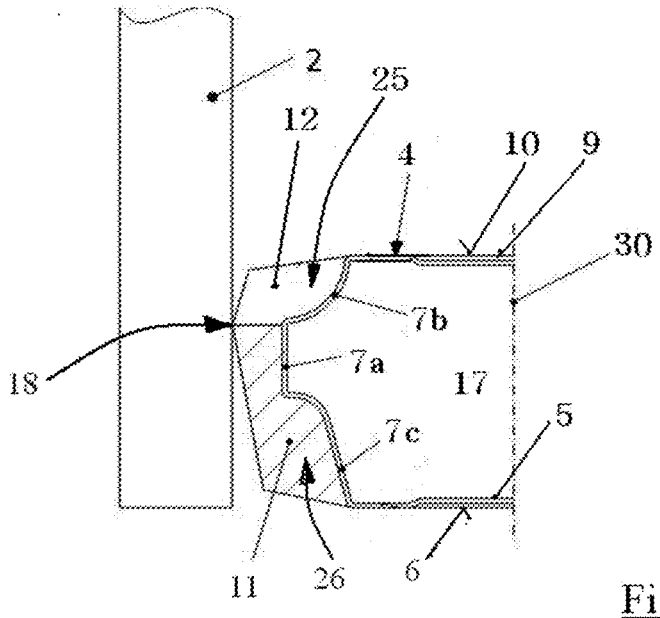
FIG. 10 shows a cross-section through a half of a spacer having altered profile shape adjacent to a glass plate, still before the compression of the insulating glass pane.
Figure 11:
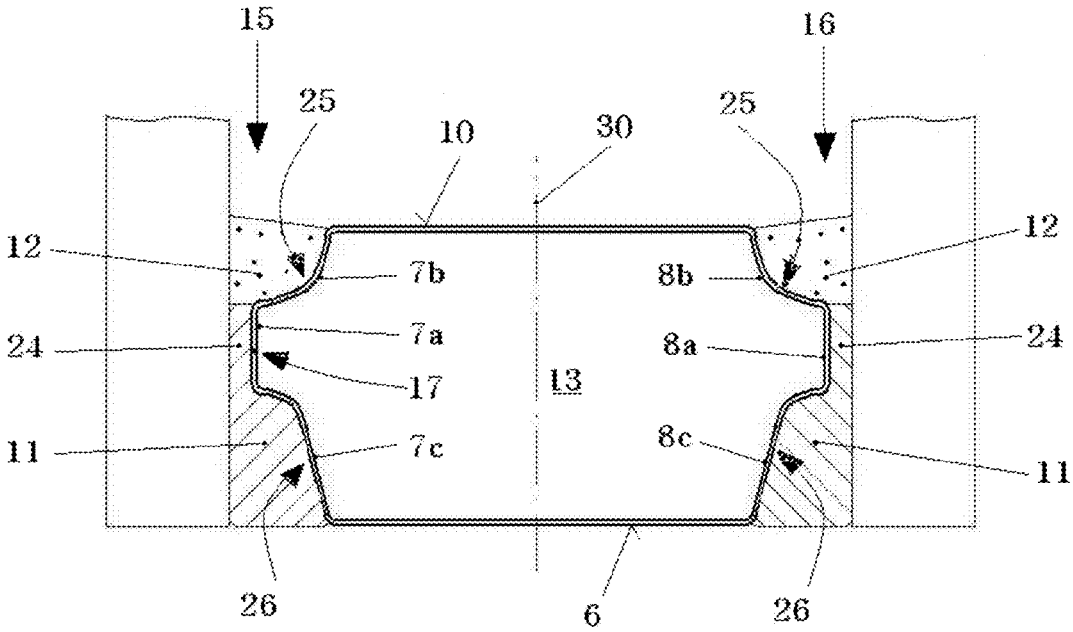
FIG. 11 shows a cross-section through a part of a compressed insulating glass pane having a spacer having the profile shape from FIG. 10.
Figure 12:
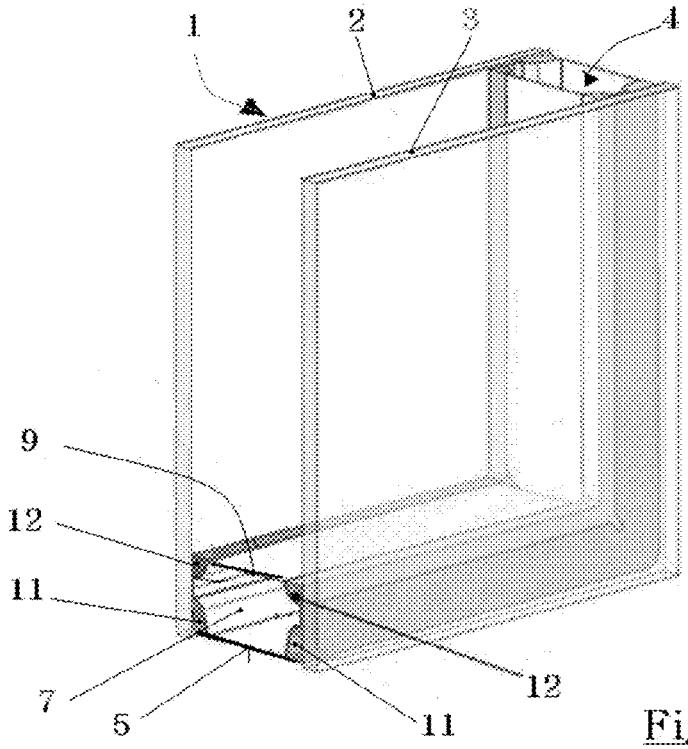
FIG. 12 shows a detail from the insulating glass pane according to FIG. 11 in a diagonal view.
Figure 13:
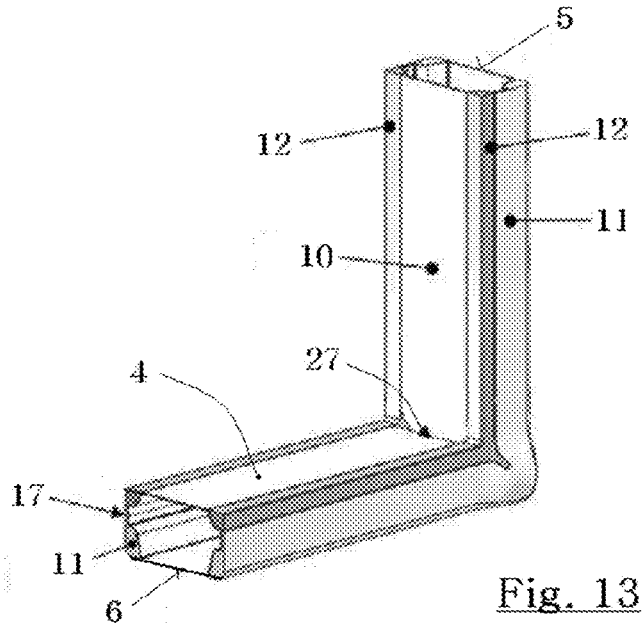
FIG. 13 shows the spacer of the compressed insulating glass pane according to FIG. 12 in a diagonal view as in FIG. 12, the glass plates not being shown, FIG. 14 schematically shows, in a cross-section through a part of an insulating glass pane as in FIG. 11, how the insulating glass pane behaves during alternating bending of its glass plates.

FIG. 9 shows a section of a hollow profile rod, from which a spacer can be formed, in a diagonal view. The hollow profile rod has a profile which is similar to the profile shown in FIG. 2. It may also have a profile as shown in FIG. 1 or FIG. 2. The hollow profile rod is formed by roll forming from a metal strip. The two edges of the metal strip meet at a flank 8 of the hollow profile rod and form a longitudinal seam 17 there, whose cohesion is ensured by welding of the two edges using a laser. Such a longitudinal seam 17 is not necessarily sealed or can become leaky. It is therefore preferable to place it on a flank 8 of the hollow profile rod on which it is covered by a sealing compound. In FIG. 9, the two edges of the metal strip overlap one another at the longitudinal seam 17. The two edges of the metal strip do not have to overlap one another at the longitudinal seam 17, however, but rather may also abut one another and be welded to one another, as shown in another profile shape in FIG. 15.

In all preceding exemplary embodiments it is preferable for the sealing compound 11, which is located in the gap 24 between the walls 7*a* and 8*a* of the spacer 4 parallel to the glass plates 2 and 3, to have a thickness of 0.75 mm to 1.25 mm, preferably approximately 1 mm, in the finished insulating glass pane 1. For clarification, it is to be noted that in the example according to FIG. 2, this does not apply for the compound 12, which is located on the shoulder 20 between the sections 7*a* and 8*a* of the flanks 7 and 8 and the top side 10 of the spacer 4, but rather only for the sealing compound 11, which is located in the narrower gap 24, which begins at the base 5 of the spacer profile and ends at the shoulder 20, where it merges into the intermediate space 25.

A difference from the prior art lies therein. In the prior art, it is typical to compress insulating glass panes so that the gap 24 between the flanks of the spacer and the diametrically opposing glass panes is reduced down to approximately 0.3 mm. For this purpose, the insulating glass panes are acted on at the height of the spacer 4, typically using a pressure of 40 N per running centimeter of the circumference of the insulating glass pane. The preferred greater thickness of the sealing compound in the gap 24 between the flanks 7 and 8 and the glass plates 2 and 3 in the spacer profiles according to FIGS. 1 to 9 is achieved in that the insulating glass pane 1 is compressed to a specified thickness, but is not solely compressed using a specified compression pressure. For this purpose, the distance of the compression plates between which the insulating glass pane is compressed to the desired thickness is monitored precisely, so that the above-mentioned layer thickness of the sealing compound 11 is actually achieved.

A compression of the insulating glass pane according to the invention using a specified pressure of 40 N per running centimeter of the circumference of the spacer or—if the circumference of the insulating glass pane corresponds to the circumference of the spacer—per running centimeter of the circumference of the insulating glass pane, for example, is also possible; for this case, a spacer profile of which an example is shown in FIGS. 10 to 14 is preferably used. In this example, the walls 7*a* and 8*a* parallel to the glass plates 2 and 3 are implemented as narrower than in the preceding examples and a further concave section 7*c* or 8*c* is provided between the outer side 6 of the base 5 of the spacer 4 and its walls 7*a* and 8*a* parallel to the glass plates 2 and 3, by which two further intermediate spaces 26 are formed between the spacer 4 and the glass plates 2 and 3 in the insulating glass pane 1, which extend from the particular gap 24 up to the outer side 6 of the base 5 and receive sealing compound, preferably a setting secondary sealing compound 11.

Such a spacer profile has two substantial advantages: On the one hand, it allows the glass plates 2 and 3 to bend as a result of variations of the external air pressure, under wind load, and under heat action, without cracks occurring in the secondary sealing compound 11 and in particular in the primary sealing compound 12, which could result in a leak. On the other hand, such a spacer profile, if the intermediate spaces 25 have a different size than the intermediate spaces 26, may be processed as desired into a spacer and installed in an insulating glass pane so that the larger intermediate space 26 is on the outside (see FIG. 11), if more secondary sealing compound 11 than compound 12 having embedded desiccant is desired in the joints 15 and 16, or is on the inside (see FIG. 12), if more compound 12 having embedded desiccant than secondary sealing compound 11 is desired in the joints 15 and 16.

Figure 14:
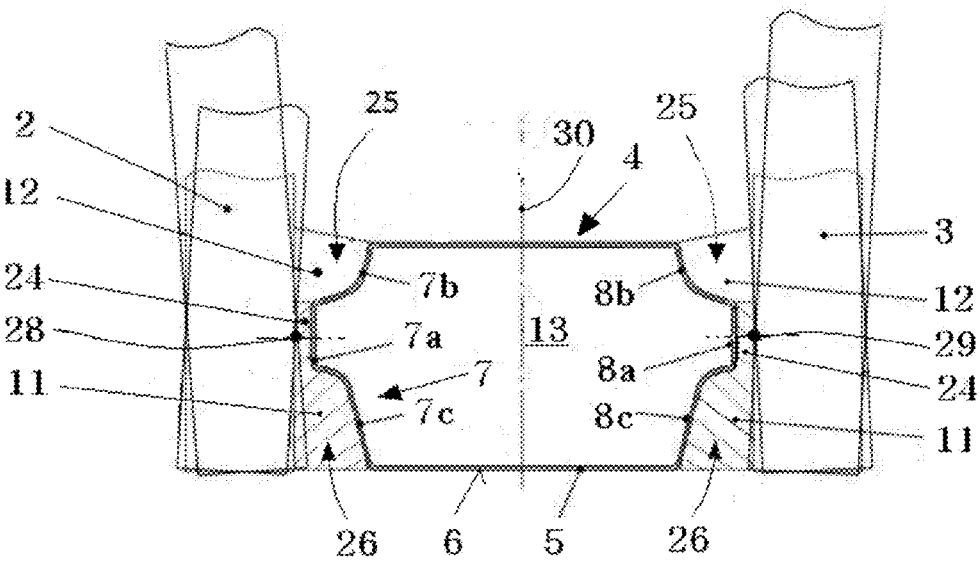

FIG. 14 shows how an insulating glass pane having such a spacer 4 behaves when the glass plates 2 and 3 of the insulating glass pane 1 are strained by bending. The glass plates 2 and 3 are shown using thick lines in a state in which they are not strained by bending. The same glass plates are shown by thin lines when they are strained by bending in one or the other direction. With respect to the spacer 4, they behave during a strain by bending as if a virtual joint or a virtual pivot axis 28 or 29, which extends in the longitudinal direction of the flank 7 or 8, were located at the height of the flat intermediate areas 7*a* and 8*a* of the flanks 7 and 8. The extent of the movement of the glass plates 2, 3 is least in the area close to the virtual pivot axis 28, 29, so that even in the case of the thinner layer of the sealing compound 11 in the gap 24, the movement of the glass plates 2 and 3 does not result in cracking of the sealing compound 11. At a greater distance from the virtual pivot axis 28, 29, at the height of the inner side 10 of the spacer and at the height of the base 5 of the spacer, the extent of the movements of the glass plates 2 and 3 is greater, but the forces which pull there on the sealing compound 11 and on the compound 12 having embedded desiccant are distributed over a substantially larger width of the joints 15 and 16, so that cracking in the compound 12 having embedded desiccant or in the sealing compound 11 also does not occur there.

In the example of FIGS. 10 to 14, the intermediate spaces 26 adjacent to the base 5 are larger than the intermediate spaces 25 adjacent to the inner side 10 of the spacer 4. The spacer profile in the exemplary embodiment of FIGS. 10 to 14 is thus asymmetrical with respect to a longitudinal central plane through the hollow profile rod, which runs at a right angle to the flat intermediate areas 7*a* and 8*a* of the flanks. However, the hollow profile rods are mirror-symmetric in relation to the other longitudinal central plane 30, which runs parallel to the flat intermediate areas 7*a* and 8*a* of the flanks.

Figure 22:
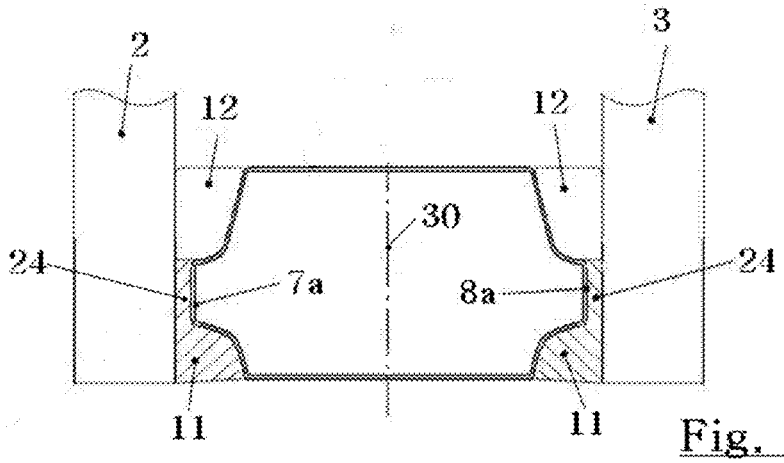

FIG. 22 shows that hollow profile rods having the profile shape shown in FIGS. 10 to 14 may also be shaped and installed in an insulating glass pane in reverse orientation to a spacer 4, i.e., the wall which forms the base 5 in FIGS. 10 to 14 forms the inner side of the spacer 4 in FIG. 22, while the wall which forms the inner side 10 of the spacer in FIGS. 10 to 14 has become the base in FIG. 22.

Figure 15:
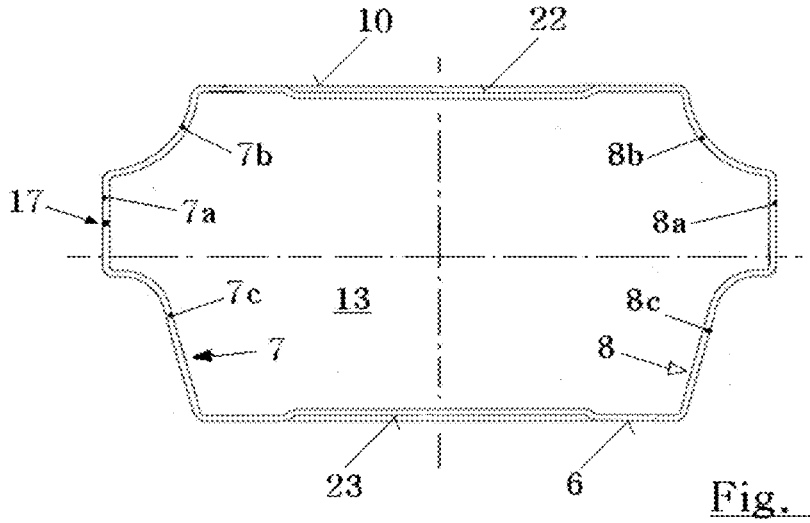
FIG. 15 shows a cross-section through a spacer of the type as shown in FIGS. 10 to 14, in which, however, the base of the spacer profile and the top side of the spacer profile diametrically opposite thereto are additionally provided with grooves.
Figure 16:
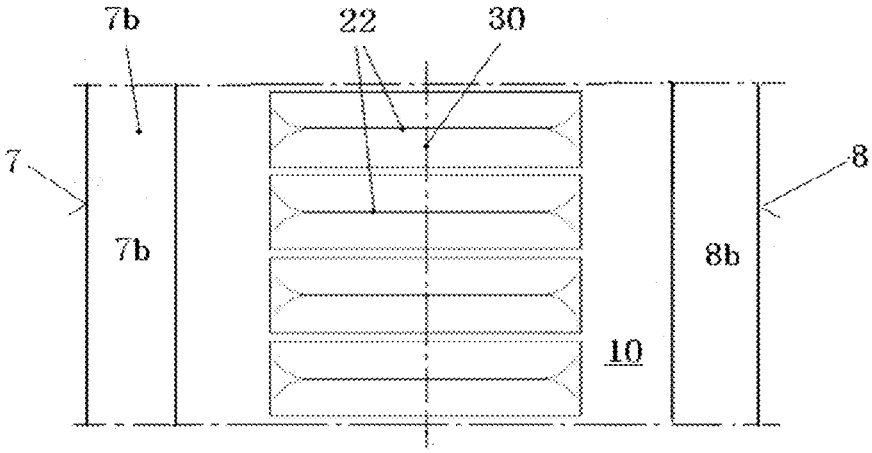
FIG. 16 shows a section of the spacer from FIG. 15 in a top view.
Figure 17:
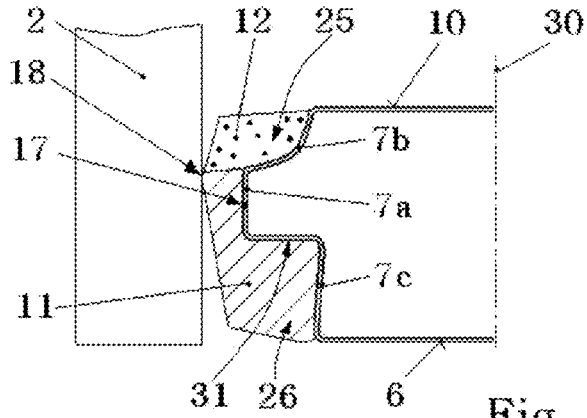
FIGS. 17 to 21 show, in views which correspond to FIGS. 10 to 14, an insulating glass pane having a spacer profile altered in relation to FIGS. 10 to 14, FIG. 22 show a cross-section through a part of an insulating glass pane having a spacer profile as in FIGS. 10 to 14, but installed in reverse in contrast thereto.
Figure 18:
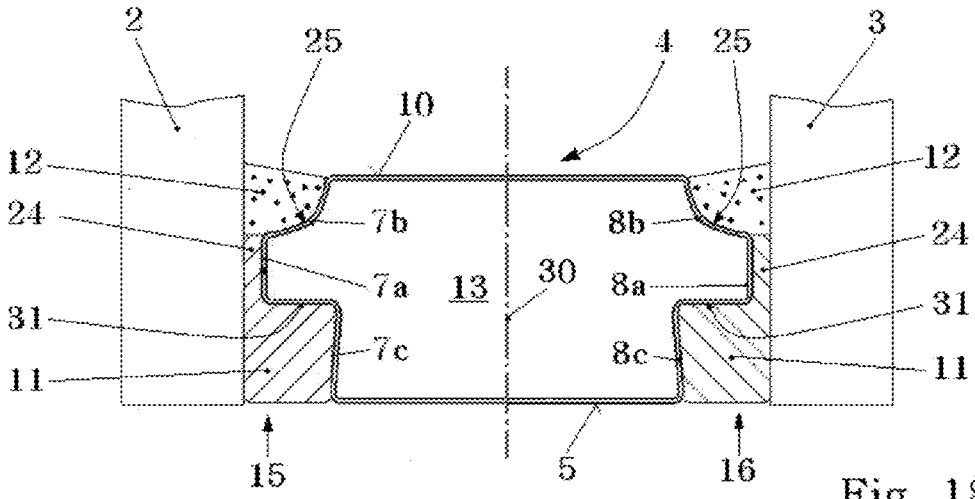
Figure 19:
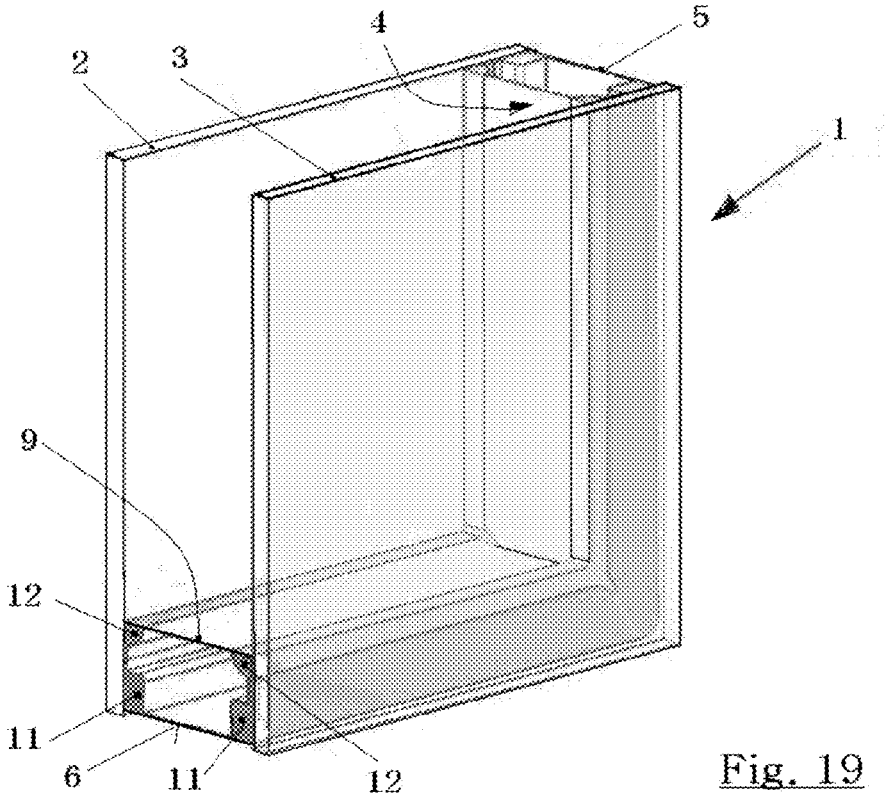
Figure 20:
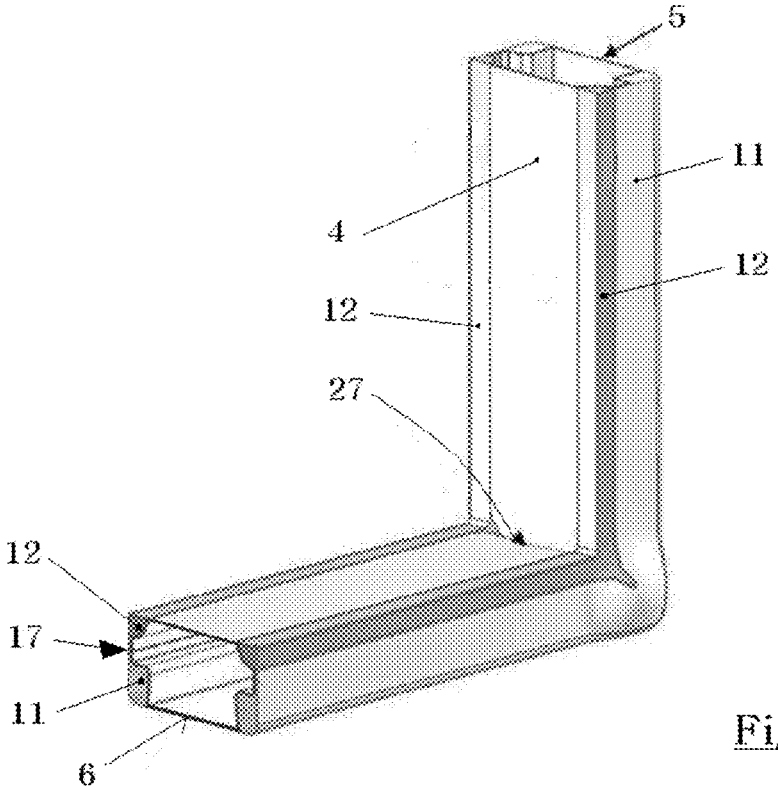
Figure 21:
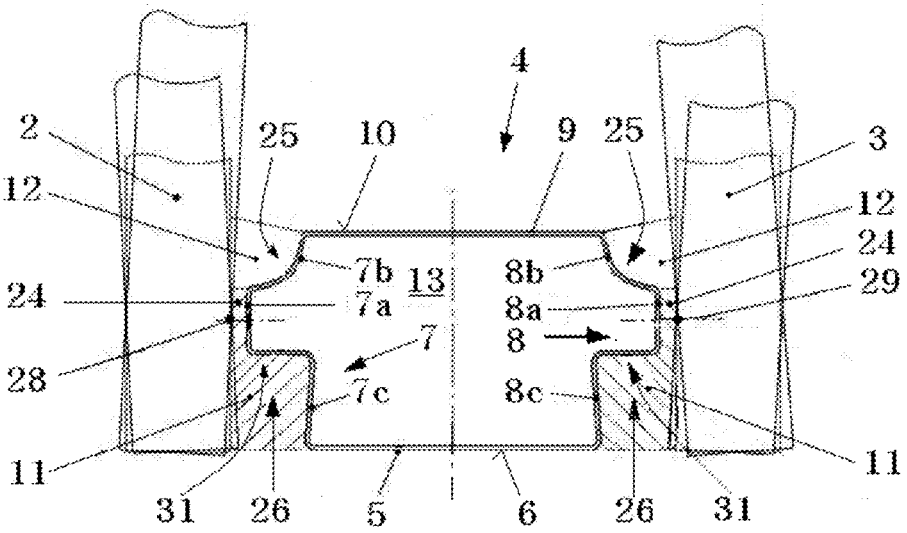

FIGS. 15 and 16 show a refinement of the spacer 4 shown in FIGS. 10 to 14. The alteration is that both the base 5 and also the inner wall 10 are continuously provided with grooves 22 or 23, which extend at a right angle to the flat intermediate areas 7*a* and 8*a* of the flanks, maintain a distance from the flanks, and are all implemented identically and are equidistant from one another. These grooves 22 and 23 may be formed by embossing. They make the bending or folding of corners of the spacer easier. Because of this advantage, it is preferable to provide the grooves 22 and 23. They are suitable for all exemplary embodiments of the present invention.

The exemplary embodiment shown in FIGS. 17 to 21 differs from the exemplary embodiment shown in FIGS. 10 to 14 only in the form of the intermediate spaces 26 which adjoin the base 5 of the spacer 4. While in the example of FIGS. 10 to 14, the intermediate spaces 26 continuously enlarge starting from the flat intermediate areas 7*a* and 8*a* up to the base 5, in the exemplary embodiment of FIGS. 17 to 21, they continuously enlarge starting from the base 5 up to the flat intermediate areas 7*a* and 8*a*, whereby an undercut has arisen viewed from the base 5, which ends at a wall 31 parallel to the base 5, which delimits the flat intermediate areas 7*a* or 8*a* in the direction outward, i.e., in the direction toward the base 5.

In regard to bending movements of the glass plates 2 and 3, the insulating glass pane shown in FIGS. 17 to 21 behaves similarly to the insulating glass pane shown in FIGS. 10 to 14.

Figure 23:
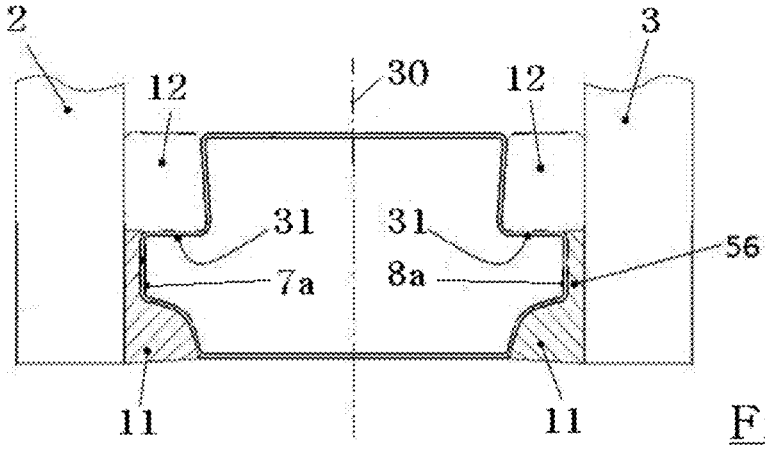
FIG. 23 shows a cross-section through a part of an insulating glass pane having a spacer profile as in FIGS. 17 to 21, but installed in reverse therefrom.

FIG. 23 shows that the profile shape used in the exemplary embodiment of FIGS. 17 to 21 can also be processed and used in an insulating glass pane in reverse to a frame-shaped spacer.

List of Reference Numerals

1 insulating glass pane
2 glass plate
3 glass plate
4 spacer
5 base
6 outer side of 5
7 flank, leg
7*a* wall of 7 parallel to the glass plate 2, intermediate area
7*b* concave section, adjoining area
7*c* further concave section, adjoining area
8 flank, leg
8*a* wall of 8 parallel to the glass plate 3, intermediate area
8*b* concave section, adjoining area
8*c* further concave section, adjoining area
9 wall parallel to the base 5
10 top side of 9, inner side of the spacer
11 secondary sealing compound
12 compound having embedded desiccant
13 interior of 4
14 adapter
15 joint
16 joint
17 longitudinal seam
18 point
19 glass plate
20 shoulder
21 sash bar
22 groove or wave in 9
23 groove or wave in 5
24 gap (part of the joint 15, 16)
25 intermediate spaces
26 further intermediate spaces
27 fold
28 virtual pivot axis
29 virtual pivot axis
30 longitudinal central plane
31 wall

The invention claimed is:

1. An insulated glass pane comprising:

a hollow frame-shaped spacer comprising a substantially box shaped profile comprising an inner wall opposite an outer wall connected by two flanks, each flank including a parallel section and an inner-side joint space;

two individual glass plates each glued to one of the two flanks with a secondary sealing compound disposed between the glass plates and the parallel section; and a primary sealing compound disposed between each of the inner-side joint spaces and each of the glass plates, the primary sealing compound including a desiccant;

wherein the inner wall and outer wall of the hollow frame-shaped spacer are substantially free of any compound.

2. The insulated glass pane according to claim 1, wherein the primary sealing compound does not set.

3. The insulated glass pane according to claim 1, wherein the primary sealing compound does set.

4. The insulated glass pane according to claim 1, wherein the primary sealing compound and secondary sealing compound are different from each other.

5. The insulated glass pane according to claim 4, wherein the secondary sealing compound is a one-component reactive adhesive or a two-component reactive adhesive.

6. The insulated glass pane according to claim 1, wherein the secondary sealing compound is a hot-melt adhesive.

7. The insulated glass pane according to claim 1, wherein the hollow frame-shaped spacer is situated so that it terminates flush with the edges of the two individual glass plates.

8. The insulated glass pane according to claim 1, wherein a profile height of the hollow frame-shaped spacer is 7 mm to 15 mm.

9. The insulated glass pane according to claim 1, wherein a profile height of the spacer is 7 mm to 9 mm.

10. The insulated glass pane according to claim 4, wherein the sealing compounds extend, taken together, over the entire height of the flanks of the hollow frame-shaped spacer.

11. The insulated glass pane according to claim 1, wherein a cavity of the hollow frame-shaped spacer does not contain any desiccant.

12. The insulated glass pane according to claim 1, wherein the inner-side joint spaces of the hollow frame-shaped spacer facing toward an interior of the insulating glass pane is narrower than the parallel sections of the hollow frame-shaped spacer.

13. The insulated glass pane according to claim 12, wherein the parallel sections of the flanks of the hollow frame-shaped spacer run parallel to one another.

14. The insulated glass pane according to claim 13, wherein the inner-side joint space of the flanks are implemented as stepped in cross-section.

15. The insulated glass pane according to claim 13, wherein the inner-side joint space of the flanks are implemented as concave in cross-section.

16. The insulated glass pane according to claim 1, wherein the flanks comprise outer-side joint spaces facing towards an exterior of the insulating glass pane which are narrower than the parallel sections of the hollow-frame shaped spacer.

17. The insulated glass pane according to claim 16, wherein the parallel sections on the respective flank of the spacer are flat.

18. The insulated glass pane according to claim 16, wherein the outer-side joint spaces of the flanks are implemented as concave in cross-section.

19. The insulated glass pane according to claim 16, wherein the outer-side joint spaces adjoining the respective parallel sections taper starting from the parallel sections toward the outer walls.

20. The insulated glass pane according to claim 16, wherein the hollow frame-shaped spacer profile runs mirror-symmetric to a longitudinal central plane of the hollow frame-shaped spacer which runs parallel to and between the parallel sections.

21. The insulated glass pane according to claim 16, wherein the outer-side joint spaces differ in their size from the inner-side joint spaces.

22. The insulated glass pane according to claim 1, wherein the hollow frame-shaped spacer has grooves or waves running perpendicularly to the flanks on its inner wall.

23. The insulated glass pane according to claim 22, wherein the grooves or waves end at a distance from the flanks.

24. The insulated glass pane according to claim 11, wherein the hollow frame-shaped spacer does not have an opening in its outer wall or inner wall.

25. The insulated glass pane according to claim 24, including a longitudinal seam along the hollow frame-shaped spacer located on a flank.

26. The insulated glass pane according to claim 25, wherein the longitudinal seam is covered by either the primary or secondary sealing compound.

27. The insulated glass pane according to claim 11, wherein neither the flanks, outer wall nor inner walls include openings to an inside of the hollow frame-shaped spacer.

28. The insulated glass pane according to claim 27, wherein the hollow frame-shaped spacer comprises an extrusion.

29. The insulated glass pane according to claim 27, wherein the hollow frame-shaped spacer is formed from a hollow profile rod produced by roll profiling of a strip-shaped sheet-metal, the longitudinal edges of the strip-shaped sheet-metal lying on one flank of the hollow profile rod and being welded to one another flank preferably continuously.

30. The insulated glass pane according to claim 1, wherein the sealing compounds provided on the flanks of the hollow frame-shaped spacer comprise a thickness of 0.75 mm to 1.25 mm.

31. The insulated glass pane according to claim 1, wherein the secondary sealing compound provided on the parallel section comprises a thickness of 0.25 mm to 0.45 mm.

* * * * *